United States Patent [19]

Trotta

[11] Patent Number: 5,018,274

[45] Date of Patent: May 28, 1991

[54] SAFETY RAZOR BLADE

[75] Inventor: Robert A. Trotta, Pembroke, Mass.

[73] Assignee: The Gillette Company, Boston, Mass.

[21] Appl. No.: 505,853

[22] Filed: Apr. 5, 1990

[51] Int. Cl.[5] ..... B26B 21/00; B26B 21/54

[52] U.S. Cl. ..... 30/50; 30/346.53; 76/104.1; 76/DIG. 8

[58] Field of Search ..... 30/346.51, 346.53, 50; 76/DIG. 8, DIG. 9, 104.1, 101.1

[56] References Cited

U.S. PATENT DOCUMENTS

| | | | |
|---|---|---|---|
| 1,920,711 | 8/1933 | Pelizzola | 30/12 |
| 2,614,321 | 10/1952 | Ackerman | 30/346.5 |
| 3,263,328 | 8/1966 | Craig | 30/346.53 |
| 3,543,402 | 4/1968 | Seager | 30/346.53 |
| 3,805,387 | 4/1974 | Siegmund et al. | 30/346.53 |
| 3,811,189 | 5/1975 | Sastri | 30/346.53 |
| 3,829,969 | 8/1974 | Fischbein | 30/346.53 |
| 3,831,466 | 8/1974 | Hicks, Jr. | 30/346.53 |
| 3,911,579 | 10/1975 | Lane et al. | 30/346.53 |
| 3,953,186 | 4/1976 | Howey | 76/DIG. 8 |
| 4,011,071 | 3/1977 | Siegmund | 30/346.53 |
| 4,056,992 | 11/1977 | Blume | 30/346.53 |
| 4,200,976 | 5/1980 | Gooding | 30/50 |
| 4,389,773 | 6/1983 | Nissen et al. | 30/50 |
| 4,603,477 | 8/1986 | Francis | 30/50 |
| 4,663,843 | 5/1987 | Savage | 30/50 |
| 4,702,004 | 10/1987 | Haythornthwaite | 30/50 |
| 4,807,360 | 2/1989 | Cerier et al. | 30/50 |

*Primary Examiner*—Douglas D. Watts
*Assistant Examiner*—Paul M. Heyrana, Sr.
*Attorney, Agent, or Firm*—Owen J. Meegan; Aubrey C. Brine; John P. Morley

[57] ABSTRACT

A blade for use in a safety razor is manufactured by providing a block of green or uncured ceramic material. The block is in the form of a honeycomb structure having a plurality of substantially parallel cells formed therein and a portion is sliced and removed from the block forming at least one surface on the portion intersecting the parallel cells at an angle. The portion is cured, and the surface ground and polished to provide a plurality of cutting edges.

20 Claims, 1 Drawing Sheet

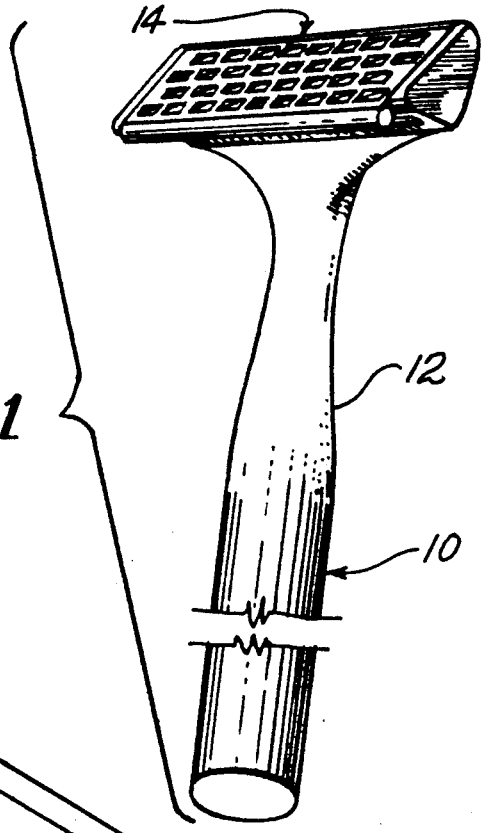
FIG. 1
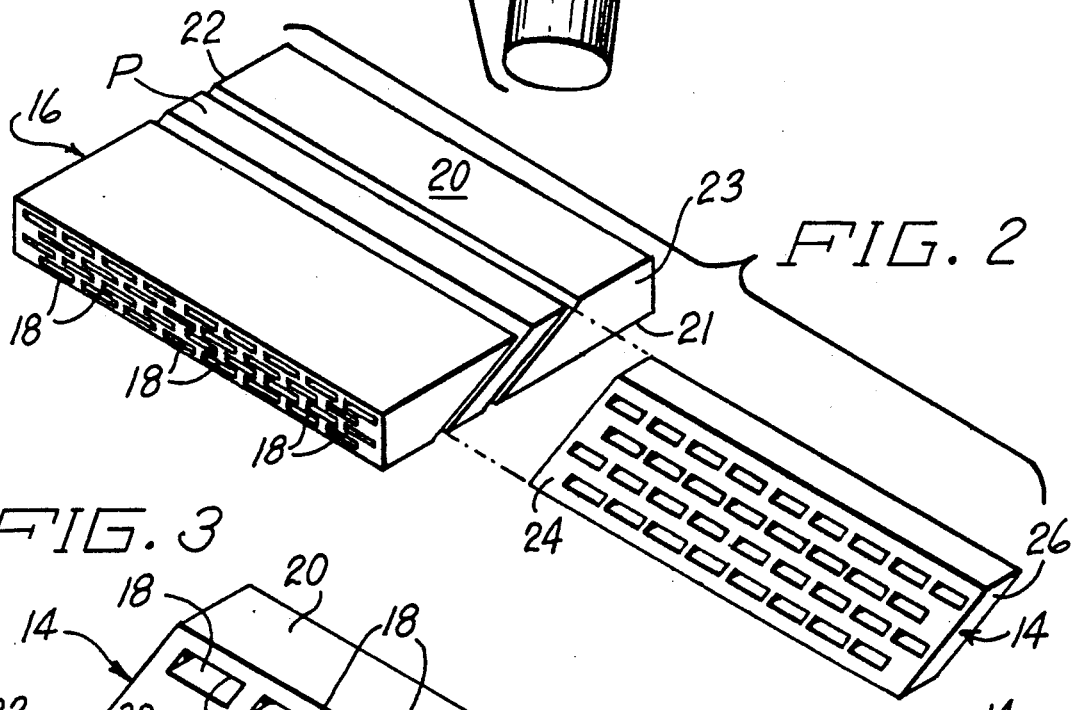
FIG. 2
FIG. 3
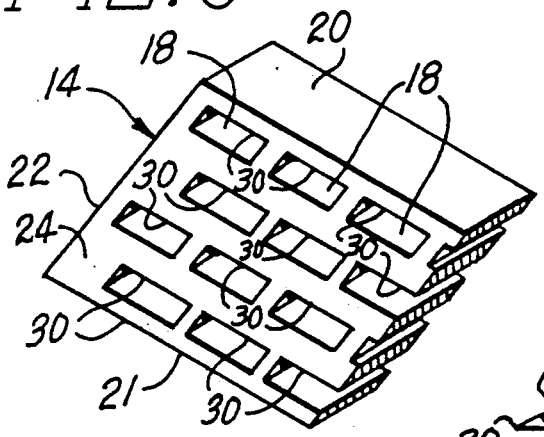
FIG. 4
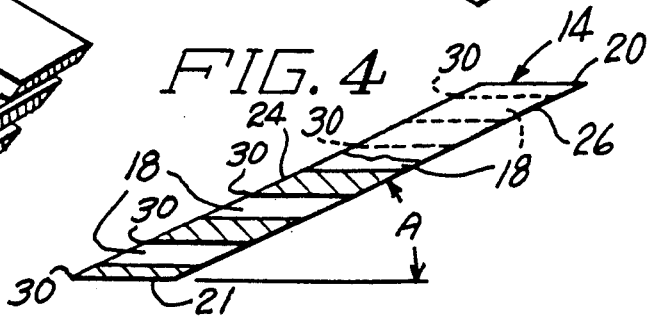

SAFETY RAZOR BLADE

BACKGROUND OF THE INVENTION

The present invention relates to a blade for use in a safety razor, and more particularly to a ceramic blade of that type, and the method of manufacturing the same.

Various blade constructions and shaving units have been disclosed in the prior art wherein the blades have been shown constructed of glass or other vitreous materials to form a blade suitable for employment in a shaving implement. For example, a ceramic cutting blade is disclosed in U.S. Pat. No. 3,543,402 issued to R. M. Seager and a blade manufactured from at least two vitreous materials is disclosed in U.S. Pat. No. 3,831,466 issued to Hicks, Jr. Other blades of glass construction are disclosed in U.S. Pat. No. 3,805,387 issued to Siegmund et al and U.S. Pat. No. 4,011,071 issued to Walter P. Siegmund. It is also suggested in the prior art that a plurality of similarly shaped hollow blades may be formed into a razor unit and such devices are shown in the above cited U.S. Pat. No. 3,805,387 issued to Siegmund et al as well as U.S. Pat. No. 4,807,360 issued to Cerier et al.

While the above attempts to create a non-metallic razor blade may be successfully accomplished, it is considered that there is a need for a more simple structure having fewer steps in fabrication in order to meet the requirements for mass production of blades in those quantities achieved in razor blade manufacture. As is obvious, the employment of a plurality of separate elements which must be fused or formed in some manner to produce the final product requires handling of a plurality of materials as well as a number of assembly and treatment steps to produce the final blade structure.

It is also evident that the employment of a plurality of components combined with a complex process renders a blade of the type under consideration costly to manufacture and therefore not applicable to employment in a razor of the discardable type which is prominent in the market today.

It is therefore an object of the present invention to provide a blade for use in a safety razor having a unitary structure which is simple to manufacture and which may be produced economically.

A further object of the present invention is to provide a blade of the type under consideration which may be manufactured under mass production techniques.

Another objection of the present invention is to provide a blade for use in a safety razor which is simple to care for during the shaving process, and is easily cleaned during the shaving process.

Yet another object of the present invention is to provide a method for manufacturing a blade from a block of ceramic material which is simple to perform and adaptable to mass production techniques.

SUMMARY OF THE INVENTION

The aforementioned objects and other objectives which will become apparent as the description proceeds are accomplished by providing a method of manufacturing a razor blade which includes the step of providing a block of ceramic material in the form of a honeycomb structure having a plurality of substantially parallel cells formed therein. At least one surface is formed on the structure intersecting each of the parallel cells at an acute angle and the one surface is ground and polished to form a plurality of sharpened edges at the intersection of the surface with the periphery of each of the cells to thereby provide a plurality of cutting edges to be used in the shaving process.

The block of ceramic material is generally provided in the green or uncured condition and is cured by sintering the formed block prior to the step of grinding and polishing. A suitable shaving surface is generally provided by applying a coating of platinum chrome to the one surface after grinding and polishing after which a telomer coating is applied over the platinum chrome.

The material employed in forming the honeycomb structure may be any of a number of hard ceramic materials as exemplified by the group consisting of zirconia, tetragonal zirconia, partially stabilized zirconia, zirconia stabilized alumina, cordierite, mullite, boron carbide, titanium nitride, silicon nitride and aluminum oxide.

The blade thus formed comprises a block of ceramic material in the form of a honeycomb structure having a plurality of substantially parallel cells formed therethrough. The blade further comprises a front surface intersecting each of the parallel cells at an acute angle thereto to form a plurality of cutting edges produced by the intersection of the front surface with each of the parallel cells. The blade may have a top surface and a bottom surface, each extending rearwardly in a direction parallel with the cells of the honeycomb structure, and the parallel cells may be rectangular in cross-section. The acute angle between the front surface and the plurality of parallel cells is generally in the area of 20° to 25°.

BRIEF DESCRIPTION OF THE DRAWING

The foregoing and other features of the invention will be more particularly described in connection with the preferred embodiment, and with reference to the accompanying drawing, wherein:

FIG. 1 is an elevational perspective view showing a shaving instrument having a blade constructed in accordance with the teachings of the present invention;

FIG. 2 is an exploded view showing the blade of FIG. 1 depicting the various steps of manufacture of the blade;

FIG. 3 is a partial elevational perspective view showing details of the blade of FIGS. 1 and 2 taken on an enlarged scale for clarity; and FIG. 4 is an elevational sectional view showing a cross-section taken through the blade of FIGS. 1 through 3 to disclose further details of the blade structure.

DESCRIPTION OF THE PREFERRED EMBODIMENT

Referring now to the drawing, and in particular to FIG. 1, there is shown a safety razor 10 comprising a handle 12 with a blade 14 mounted thereon. It should be understood that the razor 10 may be of the disposable type wherein the blade 14 is permanently affixed to the handle 12 or of the reusable type, wherein the blade 14 is removable, and may be attached by any of a plurality of means well known in the art.

Referring now to FIG. 2, the blade is generally manufactured by providing a block 16 of ceramic material in the form of a honeycomb structure having a plurality of substantially parallel cells 18 formed therein. The block 16 may be of a ceramic material such as zirconia, tetragonal zirconia, aluminum oxide, etc. as referred to hereinbefore, which are capable of being extruded into the shape shown in FIG. 2 while in the green or uncured condition. The block 16, as shown in FIG. 2, is in the form of a rectangle having a top surface 20, bottom surface 21 and side surfaces 22 and 23.

As best shown in FIG. 2, the blade 14 is formed from the block 16 while in the green or uncured state by slicing a portion P from the block at an acute angle A with the top surface 20, the bottom surface 21, and the upper and lower walls of the cells 18 which are parallel to the top and bottom surfaces of the block.

Referring now to FIG. 4, the angle A which is designated as the angle at which the blade 14 is cut from the block 16 is generally in the area of 20° to 25°. By slicing the block 16 at the acute angle A, a front surface 24 and a rear surface 26 are formed which are parallel and which intersect each of the parallel cells 18 at an angle equal to the angle A.

After the blade 14 is formed as shown in FIGS. 2 and 4, it is subjected to an elevated temperature for a period of time sufficient to properly cure or harden the particular ceramic material, which temperature and time should be known to those familiar with the particular ceramic being employed.

With the blade 14 in the hardened condition, it is subjected to a grinding and polishing process at the surface 24 (or at the surfaces 24 and 26 if both sides of the blade 14 are to be employed) such as to form a plurality of sharpened edges 30 at the intersection of the surface 24 with each of the cells 18, and with the surface 21. The blade 14 is now subjected to a coating of platinum chrome over which a telomer coating is applied to produce a blade having a plurality of cutting edges 30 which are adequately sharp and have the wearability necessary to provide a durable shaving instrument.

From the above, it should be observed that the manufacture of the blade 14 lends itself to mass production in that a block 16 of green extruded ceramic material may be sliced into a plurality of portions P which in turn are subjected to general production techniques, such as subsequent grinding, polishing and plating procedures. Also, as alluded to above, while the razor 10 depicted in FIG. 1 is shown to be a discardable shaving instrument having the blade 14 cemented or otherwise affixed to the handle 12, the blade may be incorporated into a similar handle which is manufactured to be employed over a period of time with discardable blades. In the employment of a blade 14 with a razor wherein the blade is to be inserted into the razor handle, both the surfaces 24 and 26 would be treated as set forth above and upon the requirement of a new blade, the blade would be inverted and the surface 26 would be employed in the shaving process in a similar manner as that of the surface 24.

It should therefore be evident that the present invention provides a safety razor blade which is simple to manufacture, lends itself to mass production techniques and is therefore inexpensive and readily adapted to the manufacture of a discardable razor.

I claim:

1. A method of manufacturing a razor blade which includes the steps of:

providing a unitary block of ceramic material in the form of a honeycomb structure having a plurality of substantially parallel cells formed therein;

forming at least one surface on the structure intersecting each of the parallel cells at an acute angle; and grinding and polishing the one surface to form a plurality of sharpened edges at the intersection of the one surface with the periphery of each of the cells to thereby provide a plurality of cutting edges to be employed in the shaving process.

2. A method as set forth in claim 1 wherein each of the cells is rectangular in shape.

3. A method as set forth in claim 2 wherein the block has an upper surface and a lower surface parallel to the plurality of cells.

4. A method as set forth in claim 3 wherein said block of ceramic material is provided in the green or uncured condition and further includes the step of curing the block by sintering the formed block prior to the step of grinding.

5. A method as set forth in claim 4 wherein the acute angle formed is in the area of 20° to 25°.

6. A method as set forth in claim 5 which includes the step of applying a coating of platinum chrome to the one surface after grinding and the further step of applying a telomer coating over said platinum chrome to provide a finish to said cutting edges.

7. A method as set forth in claim 6 wherein the ceramic material is one taken from the group consisting of zirconia, tetragonal zirconia, partially stabilized zirconia, zirconia stabilized alumina, cordierite, mullite, boron carbide, titanium carbide, titanium nitride, silicon carbide, silicon nitride and aluminum oxide.

8. A method as set forth in claim 1 wherein the block has an upper surface and a lower surface parallel to the plurality of cells.

9. A method as set forth in claim 1 wherein said block of ceramic material is provided in the green or uncured condition and further includes the step of curing the block by sintering the formed block prior to the step of grinding and polishing.

10. A method as set forth in claim 1 wherein the acute angle formed is in the area of 20° to 25°.

11. A method of as set forth in claim 1 which includes the step of applying a coating of platinum chrome to the one surface after grinding and polishing, and the further step of applying a telomer coating over said platinum chrome to provide a finish to said cutting edges.

12. A method as set forth in claim 1 wherein the ceramic material is one taken from the group consisting of zirconia, tetragonal zirconia, partially stabilized zirconia, zirconia stabilized alumina, cordierite, mullite, boron carbide, titanium carbide, titanium nitride, silicon carbide, silicon nitride and aluminum oxide.

13. A blade for use in a safety razor comprising:

a unitary block of ceramic material in the form of a honeycomb structure having a plurality of substantially parallel cells formed therein, said block comprising a front surface intersecting each of said parallel cells at an acute angle thereto; and a plurality of cutting edges formed by the intersection of said front surface with each of said parallel cells.

14. A blade as set forth in claim 13 wherein said block further includes a top surface and a bottom surface, each extending rearwardly in a direction parallel with said cells of said honeycomb structure.

15. A blade as set forth in claim 14 wherein said parallel cells are rectangular in cross-section.

16. A blade as set forth in claim 15 wherein said acute angle between said front surface and said plurality of parallel cells is in the area of 20° to 25°.

17. A blade as set forth in claim 16 which further includes a rear surface intersecting each of said parallel cells and wherein said front surface and said rear surface are substantially parallel.

18. A blade as set forth in claim 13 wherein said parallel cells are rectangular in cross-section.

19. A blade as set forth in claim 13 wherein said acute angle between said front surface and said plurality of parallel cells is in the area of 20° to 25°.

20. A blade as set forth in claim 13 which further includes a rear surface intersecting each of said parallel cells and wherein said front surface and said rear surface are substantially parallel.

* * * * *